US007169240B2

(12) United States Patent
Bronfin et al.

(10) Patent No.: US 7,169,240 B2
(45) **Date of Patent: *Jan. 30, 2007**

(54) CREEP RESISTANT MAGNESIUM ALLOYS WITH IMPROVED CASTABILITY

(75) Inventors: Boris Bronfin, Beer Sheva (IL); Eliyahu Aghion, Omer (IL); Frank Von Buch, Leiferde (DE); Soenke Schumann, Schwuelper (DE)

(73) Assignees: Dead Sea Magnesium Ltd. (IL); Volkswagen AG (DE)

( * ) Notice: Subject to any disclaimer, the term of this patent is extended or adjusted under 35 U.S.C. 154(b) by 65 days.

This patent is subject to a terminal disclaimer.

(21) Appl. No.: 10/038,146

(22) Filed: Jan. 3, 2002

(65) Prior Publication Data

US 2003/0086811 A1 May 8, 2003

(30) Foreign Application Priority Data

Nov. 5, 2001 (IL) ..... 146335

(51) Int. Cl.
*C22C 23/02* (2006.01)
*B22D 21/00* (2006.01)

(52) U.S. Cl. ..... 148/420; 420/413

(58) Field of Classification Search ..... 420/413; 148/420, 666, 667

See application file for complete search history.

(56) References Cited

U.S. PATENT DOCUMENTS

| | | | | |
|---|---|---|---|---|
| 6,139,651 | A | 10/2000 | Bronfin et al. | |
| 6,342,180 | B1 * | 1/2002 | Lefebvre et al. | 420/407 |
| 2001/0023720 | A1 * | 9/2001 | Ohori et al. | 148/420 |

FOREIGN PATENT DOCUMENTS

| | | | |
|---|---|---|---|
| DE | 847992 | | 9/1960 |
| EP | 0 791 662 | | 8/1997 |
| EP | 0 799 901 | | 10/1997 |
| EP | 1 048 743 | | 11/2000 |
| EP | 1 127 950 | A1 | 8/2001 |
| GB | 2 296 256 | | 6/1996 |
| JP | 06200348 | * | 7/1994 |
| WO | WO 96/25529 | | 8/1996 |
| WO | 01/44529 | | 6/2001 |

* cited by examiner

*Primary Examiner*—Sikyin Ip
(74) *Attorney, Agent, or Firm*—Anderson Kill & Olick, PC

(57) ABSTRACT

A magnesium based alloy containing at least 86 wt % Mg; 4.8 to 9.2 wt % aluminum, 0.08 to 0.38 wt % manganese, 0.00 to 0.9 wt % zinc, 0.2 to 1.2 wt % calcium, 0.05 to 1.4 wt % strontium, and 0.00 to 0.8 wt % rare earth elements. The alloy may also comprise up to 0.02 wt % zirconium and up to 0.001 wt % beryllium.

7 Claims, 6 Drawing Sheets

Table 4. Mechanical Properties and Creep Behavior

| Alloy | TYS [MPa] | | UTS [MPa] | E% | CYS [MPa] | | MCR . $10^9$ [$S^{-1}$] | | CR mg/cm$^2$/day |
|---|---|---|---|---|---|---|---|---|---|
| | 20°C | 150°C | 20°C | 20°C | 20°C | 150°C | 135°C 85 MPa | 150°C 50 MPa | |
| Example 1 | 145 | 112 | 250 | 10 | 144 | 112 | 1.8 | 1.1 | 1.48 |
| Example 2 | 145 | 108 | 244 | 10 | 147 | 105 | 1.9 | 1.2 | 1.45 |
| Example 3 | 153 | 116 | 249 | 9 | 152 | 118 | 13.6 | 3.2 | 1.40 |
| Example 4 | 153 | 130 | 253 | 8 | 155 | 132 | 1.4 | 1.1 | 0.86 |
| Example 5 | 166 | 135 | 275 | 10 | 167 | 130 | 4.8 | 1.1 | 1.24 |
| Example 6 | 164 | 125 | 272 | 8 | 165 | 125 | 5.9 | 1.8 | 1.27 |
| Example 7 | 172 | 140 | 275 | 8 | 171 | 138 | 7.1 | 1.5 | 1.01 |
| Example 8 | 175 | 130 | 272 | 6 | 174 | 130 | 8.6 | 2.2 | 1.12 |
| Example 9 | 178 | 142 | 262 | 5 | 178 | 140 | 6.9 | 1.8 | 0.93 |
| Example 10 | 175 | 120 | 260 | 5 | 174 | 122 | 11.8 | 2.7 | 1.21 |
| Example 11 | 174 | 121 | 259 | 5 | 174 | 122 | 9.4 | 2.5 | 0.98 |
| Example 12 | 164 | 115 | 252 | 6 | 166 | 112 | 12.1 | 2.9 | 1.08 |
| Example 13 | 178 | 135 | 260 | 4 | 177 | 122 | 7.2 | 1.9 | 0.95 |
| Example 14 | 182 | 122 | 266 | 4 | 181 | 138 | 11.5 | 2.5 | 1.03 |
| Comparative Example 1 | 160 | 105 | 260 | 6 | 160 | 105 | 305 | 61 | 1.31 |
| Comparative Example 2 | 135 | 100 | 240 | 12 | 135 | 100 | 12.4 | 2.2 | 1.62 |
| Comparative Example 3 | 143 | 108 | 235 | 8 | 142 | 108 | 7.8 | 2.2 | 1.56 |
| Comparative Example 4 | 182 | 138 | 238 | 1 | 181 | 137 | 12.2 | 2.3 | 1.41 |
| Comparative Example 5 | 180 | 141 | 232 | 1 | 179 | 142 | 8.3 | 2.1 | 1.43 |

Table 1. Chemical Compositions of Alloys

| Alloy | Al % | Mn % | Zn % | Ca % | Sr % | RE % | Si % | Fe % | Ni % | Cu % | Be % | Zr % |
|---|---|---|---|---|---|---|---|---|---|---|---|---|
| Example1 | 4.8 | 0.26 | 0.15 | 0.25 | 1.35 | 0.08 | 0.01 | 0.003 | 0.0007 | 0.0005 | 0.0003 | - |
| Example2 | 5.3 | 0.30 | 0.10 | 0.20 | 0.80 | 0.10 | 0.01 | 0.003 | 0.0006 | 0.0014 | 0.0004 | - |
| Example3 | 6.1 | 0.25 | 0.40 | 0.20 | 0.90 | 0.20 | 0.01 | 0.003 | 0.0002 | 0.0012 | 0.0003 | - |
| Example4 | 5.3 | 0.30 | 0.35 | 0.22 | 1.18 | 0.49 | 0.01 | 0.001 | 0.0005 | 0.0011 | - | - |
| Example5 | 7.0 | 0.32 | 0.14 | 0.53 | 0.46 | 0.15 | 0.01 | 0.001 | 0.0008 | 0.0011 | - | - |
| Example6 | 6.9 | 0.28 | 0.62 | 0.52 | 0.48 | 0.18 | 0.01 | 0.001 | 0.0007 | 0.0008 | 0.0004 | - |
| Example7 | 7.9 | 0.12 | 0.12 | 0.66 | 0.52 | 0.12 | 0.01 | 0.001 | 0.0009 | 0.0011 | | 0.01 |
| Example8 | 7.9 | 0.31 | 0.64 | 0.68 | 0.55 | 0.16 | 0.01 | 0.002 | 0.0008 | 0.0016 | - | - |
| Example9 | 8.8 | 0.24 | 0.11 | 0.85 | 0.51 | 0.03 | 0.01 | 0.001 | 0.0009 | 0.0014 | - | - |
| Example10 | 8.5 | 0.28 | 0.72 | 0.95 | 0.25 | 0.08 | 0.01 | 0.002 | 0.0008 | 0.0017 | - | |
| Example11 | 8.7 | 0.07 | 0.15 | 0.85 | 0.15 | 0.24 | 0.01 | 0.001 | 0.0009 | 0.0012 | - | 0.01 |
| Example12 | 8.9 | 0.18 | 0.48 | 0.65 | 0.05 | 0.75 | 0.01 | 0.002 | 0.0010 | 0.0009 | 0.0003 | |
| Example13 | 8.4 | 0.22 | 0.05 | 1.05 | 0.28 | 0.05 | 0.01 | 0.001 | 0.0008 | 0.0011 | - | |
| Example14 | 9.1 | 0.22 | 0.60 | 0.80 | 0.55 | 0.06 | 0.01 | 0.001 | 0.0008 | 0.0021 | - | |
| Comparative Example1 | 8.9 | 0.23 | 0.74 | - | - | - | 0.01 | 0.003 | 0.0007 | 0.0009 | 0.0009 | |
| Comparative Example2 | 4.3 | 0.29 | 0.01 | - | - | 2.4 | 0.01 | 0.003 | 0.0008 | 0.0008 | 0.0008 | |
| Comparative Example3 | 4.4 | 0.31 | 0.05 | 1.4 | 0.1 | 0.25 | 0.01 | 0.003 | 0.0006 | 0.0011 | 0.0009 | |
| Comparative Example4 | 9.4 | 0.19 | 0.54 | 1.3 | 0.45 | 0.05 | 0.01 | 0.002 | 0.0008 | 0.0012 | 0.0007 | |
| Comparative Example5 | 8.1 | 0.24 | 0.15 | 0.8 | 0.85 | 0.12 | 0.01 | 0.003 | 0.0009 | 0.0015 | 0.0004 | |

Fig. 1

Table 2. Intermetallic Phases in New Alloys

| Alloy | Phase Composition |
|---|---|
| Example 1 | $Mg\text{-}Al_{ss}$, $Al_2(Sr, Ca)_1$, $Al_x(Mn, RE)_y$ |
| Example 2 | $Mg\text{-}Al_{ss}$, $Al_2(Sr,Ca)_1$, $Al_x(Mn,RE)_y$ |
| Example 3 | $Mg\text{-}Al_{ss}$, $Al_2(Sr,Ca)_1$, $Al_y(Mn,RE)_y$ |
| Example 4 | $Mg\text{-}Al_{ss}$, $Al_2(Sr,Ca)_1$, $Al_2(Sr,Ca,RE_1)$, $Al_y(Mn,RE)_y$ |
| Example 5 | $Mg\text{-}Al_{ss}$, $Mg_{17}(Al,Ca,Sr)_{12}$, $Al_2Ca_{0.5}Sr_{0.5}$, $Al_8(Mn,RE)_5$ |
| Example 6 | $Mg\text{-}Al_{ss}$, $Mg_{17}(Al,Ca,Sr,Zn)_{12}$, $Al_8(Mn,RE)_5$, $(Al, Zn)_2Ca_{0.5}Sr_{0.5}$ |
| Example 7 | $Mg\text{-}Al_{ss}$, $Mg_{17}Al_9Ca_9Sr$, $Al_2Ca_{0.5}Sr_{0.5}$, $Al_8(Mn,RE)_5$ |
| Example 8 | $Mg\text{-}Al_{ss}$, $Mg_{17}(Al,Ca,Sr,Zn)_{12}$, $Al_8(Mn,RE)_5$, $(Al, Zn)_2Ca_{0.5}Sr_{0.5}$ |
| Example 9 | $Mg\text{-}Al_{ss}$, $Mg_{17}Al_9Ca_2Sr$, $Al_2Ca_{0.5}Sr_{0.5}$, $Al_8(Mn,RE)_5$ |
| Example 10 | $Mg\text{-}Al_{ss}$, $Mg_{17}(Al,Ca,Sr,Zn)_{12}$, $Al_8(Mn,RE)_5$, $(Al, Zn)_2Ca_{0.8}Sr_{0.2}$ |
| Example 11 | $Mg\text{-}Al_{ss}$, $Mg_{17}(Al,Ca,Sr)_{12}$, $Al_2Ca_{0.8}Sr_{0.2}$, $Al_8(Mn,RE)_5$ |
| Example 12 | $Mg\text{-}Al_{ss}$, $Mg_{17}(Al,Ca,Sr,Zn)_{12}$, $Al_2(Ca,RE)_2$, $Al_8(Mn,RE)_5$ |
| Example 13 | $Mg\text{-}Al_{ss}$, $Mg_{17}(Al,Ca,Sr,Zn)_{12}$, $Al_8(Mn,RE)_5$, $(Al, Zn)_2(Ca, Sr)_1$ |
| Example 14 | $Mg\text{-}Al_{ss}$, $Mg_{17}(Al,Ca,Sr,Zn)_{12}$, $Al_8(Mn,RE)_5$, $(Al, Zn)_2Ca_{0.5}Sr_{0.5}$ |
| Comparative example 1 | $Mg\text{-}Al_{ss}$, $Mg_{17}(Al,Zn)_{12}$, $Al_8Mn_5$ |
| Comparative example 2 | $Mg\text{-}Al_{ss}$, $Al_{11}RE_3$, $Al_{10}RE_2Mn_7$ |
| Comparative example 3 | $Mg\text{-}Al_{ss}$, $Al_2(Ca,Sr)_1$, $Al_y(Mn,RE)_y$ |
| Comparative example 4 | $Mg\text{-}Al_{ss}$, $Mg_{17}(Al,Ca,Sr,Zn)_{12}$, $Al_8(Mn,RE)_5$, $(Al, Zn)_2(Ca, Sr)_1$ |
| Comparative example 5 | $Mg\text{-}Al_{ss}$, $Mg_{17}(Al,Ca,Sr)_{12}$, $Al_2(Ca,Sr)_1$, $Al_8(Mn,RE)_5$ |

Fig. 2

Table 3. Die Castability Properties

| Alloy | Casting temperature [°C] | Oxidation Resistance | Fluidity | Die Sticking | Rank |
|---|---|---|---|---|---|
| Example 1 | 690 | 9.5 | 9 | 8.5 | 88 |
| Example 2 | 690 | 9.5 | 9 | 9 | 91 |
| Example 3 | 680 | 10 | 10 | 9.5 | 96 |
| Example 4 | 690 | 9.5 | 9 | 9 | 92 |
| Example 5 | 680 | 10 | 10 | 10 | 100 |
| Example 6 | 660 | 10 | 8.5 | 9 | 91 |
| Example 7 | 670 | 10 | 10 | 10 | 100 |
| Example 8 | 660 | 10 | 9 | 9.5 | 95 |
| Example 9 | 670 | 10 | 10 | 10 | 100 |
| Example 10 | 680 | 10 | 10 | 9 | 93 |
| Example 11 | 670 | 10 | 10 | 9.5 | 97 |
| Example 12 | 670 | 10 | 10 | 9 | 93 |
| Example 13 | 670 | 10 | 10 | 9 | 90 |
| Example 14 | 660 | 10 | 9 | 9 | 92 |
| Comparative Example 1 | 670 | 9.5 | 10 | 10 | 99 |
| Comparative Example 2 | 690 | 8 | 8 | 9 | 80 |
| Comparative Example 3 | 700 | 8 | 8 | 6 | 67 |
| Comparative Example 4 | 670 | 10 | 10 | 7 | 80 |
| Comparative Example 5 | 660 | 10 | 10 | 7 | 80 |

Fig. 3

Table 4. Mechanical Properties and Creep Behavior

| Alloy | TYS [MPa] | | UTS [MPa] | E% | CYS [MPa] | | MCR . $10^9$ [$S^{-1}$] | | CR $mg/cm^2/day$ |
|---|---|---|---|---|---|---|---|---|---|
| | 20°C | 150°C | 20°C | 20°C | 20°C | 150°C | 135°C 85 MPa | 150°C 50 MPa | |
| Example 1 | 145 | 112 | 250 | 10 | 144 | 112 | 1.8 | 1.1 | 1.48 |
| Example 2 | 145 | 108 | 244 | 10 | 147 | 105 | 1.9 | 1.2 | 1.45 |
| Example 3 | 153 | 116 | 249 | 9 | 152 | 118 | 13.6 | 3.2 | 1.40 |
| Example 4 | 153 | 130 | 253 | 8 | 155 | 132 | 1.4 | 1.1 | 0.86 |
| Example 5 | 166 | 135 | 275 | 10 | 167 | 130 | 4.8 | 1.1 | 1.24 |
| Example 6 | 164 | 125 | 272 | 8 | 165 | 125 | 5.9 | 1.8 | 1.27 |
| Example 7 | 172 | 140 | 275 | 8 | 171 | 138 | 7.1 | 1.5 | 1.01 |
| Example 8 | 175 | 130 | 272 | 6 | 174 | 130 | 8.6 | 2.2 | 1.12 |
| Example 9 | 178 | 142 | 262 | 5 | 178 | 140 | 6.9 | 1.8 | 0.93 |
| Example 10 | 175 | 120 | 260 | 5 | 174 | 122 | 11.8 | 2.7 | 1.21 |
| Example 11 | 174 | 121 | 259 | 5 | 174 | 122 | 9.4 | 2.5 | 0.98 |
| Example 12 | 164 | 115 | 252 | 6 | 166 | 112 | 12.1 | 2.9 | 1.08 |
| Example 13 | 178 | 135 | 260 | 4 | 177 | 122 | 7.2 | 1.9 | 0.95 |
| Example 14 | 182 | 122 | 266 | 4 | 181 | 138 | 11.5 | 2.5 | 1.03 |
| Comparative Example 1 | 160 | 105 | 260 | 6 | 160 | 105 | 305 | 61 | 1.31 |
| Comparative Example 2 | 135 | 100 | 240 | 12 | 135 | 100 | 12.4 | 2.2 | 1.62 |
| Comparative Example 3 | 143 | 108 | 235 | 8 | 142 | 108 | 7.8 | 2.2 | 1.56 |
| Comparative Example 4 | 182 | 138 | 238 | 1 | 181 | 137 | 12.2 | 2.3 | 1.41 |
| Comparative Example 5 | 180 | 141 | 232 | 1 | 179 | 142 | 8.3 | 2.1 | 1.43 |

Fig. 4

CREEP RESISTANT MAGNESIUM ALLOYS WITH IMPROVED CASTABILITY

FIELD OF THE INVENTION

The present invention relates to magnesium-based alloys with good creep resistance and improved castability, which are suitable for elevated temperature applications, and which have good corrosion resistance.

BACKGROUND OF THE INVENTION

Magnesium alloys, being one third lighter than an equal volume of aluminum alloys, offer many possibilities for weight reduction, and are, therefore, very attractive in such applications as automotive and aerospace industries. After CAFÉ and other environmental legislation, most car manufacturers have set targets to use 40–100 kg of magnesium alloys per car in the near future. Magnesium alloy components are produced by various casting processes, including high-pressure die-casting, sand casting and permanent mold casting. Other relevant production technologies are squeeze casting, semi-solid casting, thixocasting and thixomolding. According to the forecast of the International Magnesium Association (IMA), the use of die-casting magnesium will continue to grow. An ideal magnesium alloy for making automobile parts, beside being cost effective, should meet several conditions related to its behavior during the casting process and during its use under continued stress. The good castability includes good flow of melted alloy into thin mold sections, low sticking of the melted alloy to the mold, and resistance to oxidation during the casting process. A good alloy should not develop cracks during cooling and solidifying stage of casting. The parts that are cast of the alloy should have high tensile and compressive yield strength, and during their usage they should show a low continued strain under stress at elevated temperatures (creep resistance). The good mechanical properties should be preferably kept even at temperatures higher than 120° C., if the parts are intended as parts of the gear-box or a crankcase. The alloy should also be resistant to the corrosion. The physical and chemical properties of the alloy depend in a substantial way on the presence of other metallic elements, which can form a variety of intermetallic compounds. These intermetallic compounds impede grain sliding under stress at elevated temperatures.

All conventional die casting magnesium alloys are based on Mg—Al system. The alloys of the Mg—Al—Zn system (e.g., commercially available alloy AZ91D) or of Mg—Al—Mn system have good castability, corrosion resistance and combination of ambient strength and ductility, however they exhibit poor creep resistance and elevated-temperature strength. On the other hand, Mg—Al—Si alloys and Mg—Al—RE alloys reveal improved creep resistance but exhibit insufficient corrosion resistance (AS41 and AS21 alloys) and poor castability (AS21 and AE42 alloys). Both types of alloys further exhibit relatively low tensile yield strength at ambient temperature. In addition, high content of rare elements (RE), e.g. 2.4% in AE42, increases the costs. The inclusion of Ca or Sr in the alloy was shown to overcome some of the mentioned drawbacks. German Patent Specification No 847,992 describes magnesium-based alloys, which contain 2 to 10 wt % aluminum, 0 to 4 wt % Zinc, 0.001 to 0.5 wt % manganese, 0.5 to 3 wt % calcium and up to 0.005 wt % beryllium. In addition, these alloys also contain relative high concentration of iron (up to 0.3 wt %) in order to suppress hot cracking problems. The publication GB 2,296,256 discloses a magnesium-based alloy containing up to 2 wt % RE and up to 5.5 wt % Ca. WO 9625529 discloses a magnesium-based alloy containing up to 0.8 wt % calcium which has a creep strain of less than 0.5% under an applied stress of 35 MPa at 150° C. for 200 hours. EP 799901 describes a magnesium-based alloy for semi-solid casting which contains up to 4 wt % calcium and up to 0.15 wt % strontium, wherein the ratio Ca/Al should be less than 0.8. EP 791662 discloses a magnesium-based alloy comprising up to 3 wt % Ca and up to 3 wt % of RE elements, wherein the alloys are die-castable only for certain ratios of the elements. EP 1048743 teaches a method for making a magnesium alloy for casting, comprising Ca up to 3.3% and Sr up to 0.2%. U.S. Pat. No. 6,139,651 discloses a magnesium-based alloy comprising Ca up to 1.2 wt %, Sr up to 0.2 wt %, while Zn is in either of the ranges 0.01 to 1, and 5 to 10 wt %. WO 0144529 describes a magnesium-based casting alloy comprising up to 2.2 wt % Sr.

It is an object of this invention to provide alloys with improved strength at ambient and elevated temperatures, as well as improved creep resistance at elevated temperatures up to at least 150° C.

It is another object of this invention to provide alloys, which are particularly well adapted for high-pressure die casting process, exhibiting reduced susceptibility to die sticking, oxidation, and hot cracking, and which have good fluidity.

It is still another object of this invention to provide magnesium-based alloys suitable for elevated temperature applications, which have a good corrosion resistance.

It is a further object of this invention to provide alloys, which may also be used for other applications such as sand casting, permanent mold casting, squeeze casting, semi-solid casting, thixocasting and thixomolding. It is a still further object of this invention to provide alloys, which can be successfully cast though being beryllium free.

It is also an object of this invention to provide alloys, which exhibit the aforesaid behavior and properties and have a relatively low cost.

Other objects and advantages of present invention will appear as description proceeds.

SUMMARY OF THE INVENTION

The present invention relates to magnesium-based alloys with good creep resistance and castability, which are suitable for elevated temperature applications, and which have good corrosion resistance. Said alloys comprise aluminum, manganese, zinc, calcium, strontium, zirconium, and rare earth elements. The alloys of this invention contain at least 86 wt % Mg, 4.8 to 9.2 wt % calcium, 0.05 to 1.4 wt % strontium, 0.000 to 0.8 wt % rare earth elements, and 0.00 to 0.02 wt % zirconium, and they may comprise beryllium up to 0.004 wt %. The content of iron, nickel, copper, and silicon in the alloy is not higher than 0.004 wt %, 0.003 wt %, and 0.03 wt %, respectively. The sum of calcium and strontium contents is higher than 0.9 wt % and lower than 1.6 wt %. The microstructure of an alloy according to this invention comprise Mg—Al solid solution as a matrix, and intermetallic compounds $Mg_{17}Al_9Ca_2Sr$, $Al_2Ca_{0.5}SR_{0.5}$, $Al_8(Mn,RE)_5$, $Al_2(Sr,Ca)_1$, $Al_x(Mn,RE_y$ located at grain boundaries of said Mg—Al solid solution.

The alloys of this invention show good strength and creep properties both at ambient temperatures and at 150° C., and have a good corrosion resistance. During the casting process they exhibit good fluidity, low sticking to die, and the low susceptibility to oxidation and hot cracking. The alloys have also a relatively low cost.

The invention also relates to alloys that can be used in various processes, comprising high-pressure die-casting, sand casting, permanent mold casting, squeeze casting, semi-solid casting, thixocasting and thixomolding.

The invention further relates to articles produced by casting a magnesium-based alloy having the composition defined hereinbefore, which alloy has good creep resistance and castability. Said articles are suitable for elevated temperature applications, and have good corrosion resistance.

BRIEF DESCRIPTION OF THE DRAWINGS

The above and other characteristics and advantages of the invention will be more readily apparent through the following examples, and with reference to the appended drawings, wherein:

FIG. 1 is Table 1, showing chemical compositions of alloys;

FIG. 2 is Table 2, showing intermetallic phases in new alloys;

FIG. 3 is Table 3, showing the castability properties of new alloys;

FIG. 4 is Table 4, showing the mechanical properties of new alloys;

DETAILED DESCRIPTION OF THE INVENTION

Figure 5A:
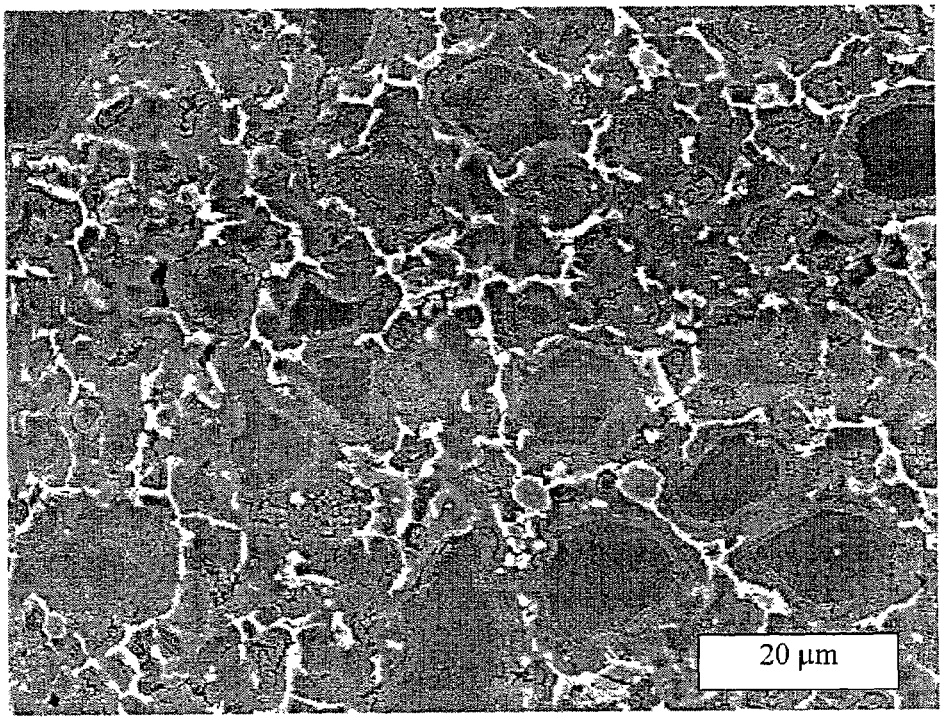
FIGS. 5, A and B, show the microstructures of a die-cast alloy according to Example 4 and Example 8, respectively.

It has now been found that certain combinations of elements in magnesium based alloys, comprising aluminum, manganese, zinc, calcium, strontium, zirconium and rare earth elements, lead to properties superior to those of the prior art alloys. These properties include excellent molten metal behavior and castability, improved creep resistance, corrosion resistance, as well as high tensile and compressive yield strength at ambient and elevated temperatures.

A magnesium-based alloy of the present invention comprises 4.8 to 9.2 wt % aluminum. If the aluminum concentration is lower than 4.8 wt % the alloy will not exhibit good castability, particularly in relation to the fluidity. On the other hand aluminum concentration higher than 9.2 wt % leads to embrittlement and deterioration of creep resistance. The alloys of the present invention contain from 0.08 to 0.38 wt % of manganese, and may contain up to 0.9% zinc. An alloy of the present invention contains both calcium and strontium. The preferred range for calcium is 0.2 to 1.2 wt %, and the preferred range for strontium is 0.05 to 1.4 wt %. The presence of both these elements significantly improves creep resistance through the formation of stable intermetallic compounds, which impede grain sliding. The total amount of calcium and strontium should be higher than 0.9 wt % to suppress the formation of β-phase, $Mg_{17}(Al, Zn)_{12}$ intermetallic compounds, and to provide improved creep resistance. On the other hand, the total amount of calcium and strontium should not exceed 1.6% in order to avoid embrittlement, and sticking of the castings to the die followed by hot cracking. The presence of calcium further favors the oxidation resistance of the alloys. It was found that most of the alloys of this invention can be prepared in ingot form and then be die-cast as beryllium-free. The alloys of this invention may contain up to 0.8 wt % rare earth elements. Rare earth elements modify the precipitated intermetallic compounds and increase their stability. In addition, the presence of RE elements improves corrosion resistance. However, the alloying with more than 0.8 wt % RE elements leads to decreasing strength properties and deteriorated castability, not mentioning the increased costs.

The alloys of the present invention have minimal amounts of iron, copper and nickel, to maintain a low corrosion rate. There is less than 0.004 wt % iron, and preferably less than 0.003 wt % iron in the alloy. The iron content can be reduced by adding manganese. The iron content of less than 0.003 wt % can be achieved at minimal residual manganese content 0.17 wt %, however, the same result can be achieved with only 0.08 wt % of manganese if a small amount of zirconium, up to 0.02 wt %, is also present. The alloy according to this invention does not contain more than 0.001 wt % nickel, more than 0.003 wt % copper, and more than 0.03% silicon.

In the preferred embodiment of the invention, a magnesium based alloy contains 7.8 to 8.8 wt % aluminum, 0.00 to 0.3 wt % zinc, 0.65 to 1.05 wt % calcium, 0.15 to 0.65 wt % strontium, 0.00 to 0.2 wt % rare earth elements, and 0.08 to 0.28 wt % manganese, wherein the rare earth elements are added as cerium-based mischmetal. The alloy according to this preferred embodiment comprises an Mg—Al solid solution as a matrix, and intermetallic compounds $Mg_{17}Al_9Ca_2Sr$, $Al_2Ca_{0.5}Sr_{0.5}$, and $Al_8(Mn,RE)_5$, wherein the said intermetallic compounds are located at grain boundaries of the Mg—Al solid solution.

In another preferred embodiment of the present invention, a magnesium-based alloy, contains 4.8 to 6.0 wt % aluminum, 0.10 to 0.37 wt % manganese, 0.00 to 0.3 wt % zinc, 0.15 to 0.30 wt % calcium, 0.7 to 1.4 wt % strontium, and 0.1 to 0.6 wt % rare earth elements, wherein the rare earth elements are added as cerium-based mischmetal. The alloy according to this preferred embodiment comprises an Mg—Al solid solution as a matrix, and intermetallic compounds grain $Al_2(Sr,Ca)$; $Al_2(Sr,Ca,RE)_1$ and $Al_x(Mn,RE)_y$, wherein the said intermetallic compounds are located at grain boundaries of the Mg—Al solid solution.

It has been found that also some other intermetallic compounds, beside those specified above, precipitate in an alloy of this invention in the presence of calcium, strontium, rare earth elements, zinc and manganese, in the weight percentages set forth hereinbefore, comprising $Mg_{17}(Al,Ca,Sr)_{12}$, $Mg_{17}(Al,Ca,Sr,Zn)_{12}$, and $(Al,Zn)_2(Ca,Sr)$. These intermetallic phases were found at grain boundaries of the solid solution of the Mg—Al matrix.

The magnesium alloys of the present invention have been tested and compared with comparative samples, including largely used, commercially available, magnesium alloys AZ91D and AE42. Metallography examination by scanning electron microscopy, and X-ray diffraction analysis of the precipitates showed distinct differences between comparative samples and alloys according to the present invention, for example, in the formation of new intermetallic precipitates. The microstructure of the new alloys, for example, consisted of fine grains Mg—Al solid solution and eutectic phases located at grain boundaries.

Castability was evaluated by combining three parameters that characterize alloy behavior during the casting process: fluidity, sticking to the die, and oxidation resistance. Of all the comparative samples, only AZ91D alloy had similar castability as the alloys of the present invention, of which casting behavior was considerably better than that of AE42 alloy.

Tensile and compression testing revealed that the alloys of the present invention exhibit tensile yield strength (TYS) and compressive yield strength (CYS) significantly higher than AZ91D and AE42 alloys, both at ambient temperature and at 150° C.

Corrosion resistance of the new alloys, as measured by immersion in NaCl solution, was similar or better than that of AZ91D alloy and significantly better that of AE42 alloy.

Creep behavior was measured at 135° C. and 150° C. for 200 hrs under a stress of 85 MPa and 50 MPa respectively. The selection of the conditions is based on requirements for power train components like gearbox housing, intake manifolds etc. Creep resistance was characterized by the value of the minimum creep rate, which is considered as the most important design parameter for power train components. The alloys of the present invention had better creep resistance than AE42 alloy, and still much better that of AZ91D alloy.

In a preferred embodiment, an article made of an alloy according to the present invention is high-pressure die cast.

In other embodiments of this invention, an article made of an alloy according to the present invention is cast by a procedure chosen among sand casting, permanent mold casting squeeze casting, semi-solid casting, thixocasting and thixomolding.

Based on the above findings, the present invention is also directed to the articles made of magnesium alloys components, said articles having improved strength, creep resistance, and corrosion resistance at ambient temperatures and at elevated temperatures, wherein said articles are used as parts of automotive or aerospace construction systems.

The invention will be further described and illustrated in the following examples.

EXAMPLES

General Procedures

The alloys of the present invention were prepared in 100 liter crucible made of low carbon steel. The mixture of $CO_2$+0.5% $SF_6$ was used as a protective atmosphere. The raw materials used were as follows:

Magnesium—pure magnesium, grade 9980A, containing at least 99.8% Mg.

Manganese—an Al-60% Mn master alloy that was added into the molten magnesium at a melting temperature from 700° C. to 720° C., depending on the manganese concentration. Special preparation of the charged pieces and intensive stirring of the melt for 15–30 min have been used to accelerate manganese dissolution in the molten magnesium.

Aluminum—commercially pure Al (less than 0.2% impurities).

Rare earth elements—a cerium based mishmetal containing 50% Ce+25% La+20% Nd+5% Pr.

Calcium—a master alloy Al-75% Ca.

Strontium—a master alloy Al-90% Sr.

Zinc—commercially pure Zn (less than 0.1% impurities).

Typical temperatures for introducing Al, Ca, Sr, Sn, and Zn were from 690° C. to 710° C. Intensive stirring for 2–15 min was sufficient for dissolving these elements in the molten magnesium.

Beryllium—the additions of 3–4 ppm of beryllium were introduced in some of the new alloys in the form of a master alloy Al-1% Be, after tempering the melt at temperatures of 660–690° C. prior to casting. However, most of the new alloys were prepared and cast as Be free.

After preparing the required compositions, the alloys were cast into the 8 kg ingots. The casting was carried out without any protection of the molten metal during solidification in the molds. Neither burning nor oxidation was observed on the surface of all the experimental ingots. Chemical analysis was performed using spark emission spectrometer. The die casting trials were performed using an IDRA OL-320 cold chamber die casting machine with a 345 ton locking force. The die used for producing test samples was a six cavity mold producing:

- two round specimens for tensile test as per ASTM Standard B557M-94,
- one sample suitable for creep testing,
- one sample suitable for fatigue testing,
- one ASTM E23 standard impact test sample,
- one round sample with diameter of 10 mm for immersion corrosion test as per ASTM G31 standard.

The die castability was evaluated during die casting trials by observing fluidity (F), oxidation resistance (OR) and die sticking (D). Each alloy was rated, according to increasing quality, from 1 to 10 with regard to the three properties. The combined "castability factor" (CF) was calculated by weighing the tree parameters, wherein die sticking had weight factor 4, and fluidity with oxidation had each weight factor 1:

$$CF = \left[\frac{T}{670} \cdot OR + \frac{670}{T} \cdot F + 4D\right]\frac{100}{60}$$

where T is actual casting temperature, and 670 is the casting temperature for AZ91D alloy [° C.].

Metallography examination was performed using an optical microscope and scanning electron microscope (SEM) equipped with an energy dispersive spectrometer (EDS). The phase compositions were determined using X-Ray diffraction analysis combined with EDS analysis.

Tensile and compression testing at ambient and elevated temperatures were performed using an Instron 4483 machine equipped with an elevated temperature chamber. Tensile yield strength (TYS), ultimate tensile strength (UTS) and percent elongation (% E), and compression yield strength (CYS) were determined.

The SATEC Model M-3 machine was used for creep testing. Creep tests were performed at 135° C. and 150° C. for 200 hrs under a stress of 85 MPa and 50 MPa respectively. The selection of the conditions was based on creep behavior requirements for power train components like gearbox housing, intake manifolds etc. Creep resistance was characterized by the value of the minimum creep rate (MCR), which is considered as the most important design parameter for power train components.

The corrosion behavior was evaluated using the immersion corrosion test according to ASTM Standard G31-87. The tested samples, cylindrical rods 100 mm long and 10 mm in diameter, were degreased in acetone and then immersed in 5% NaCl solution at ambient conditions, 23±1° C., for 72 hours. Five replicates of each alloy were tested. The samples were then stripped of the corrosion products in a chromic acid solution (180 g $CrO_3$ per liter solution) at 80° C. for about three minutes. The weight loss was determined, and used to calculate the average corrosion rate in mg/cm$^2$/day.

Examples of Alloys

Figure 5B:
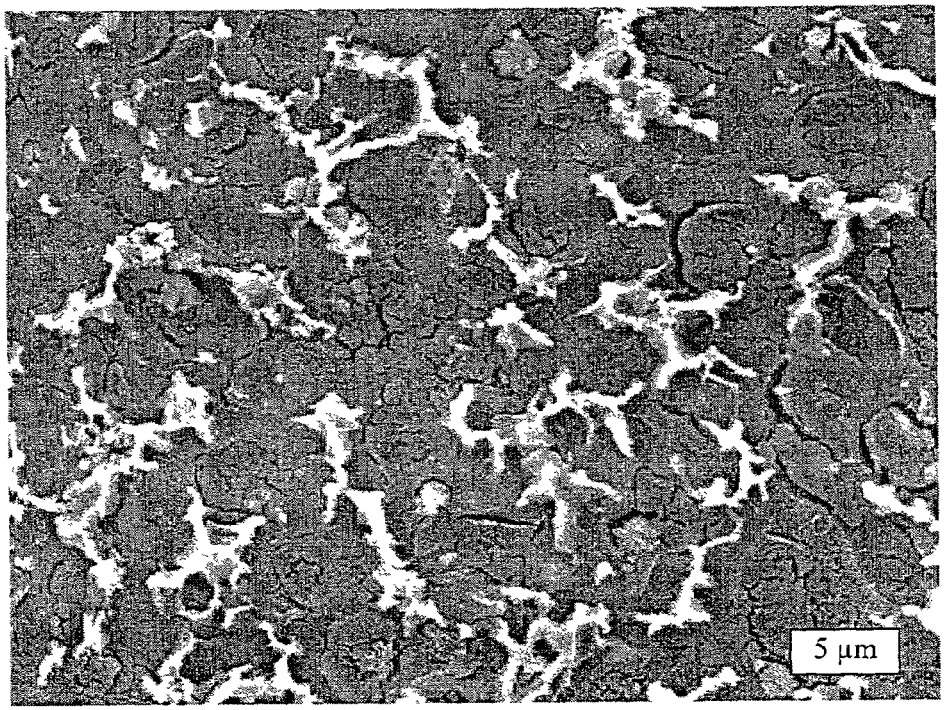
Figure 6A:
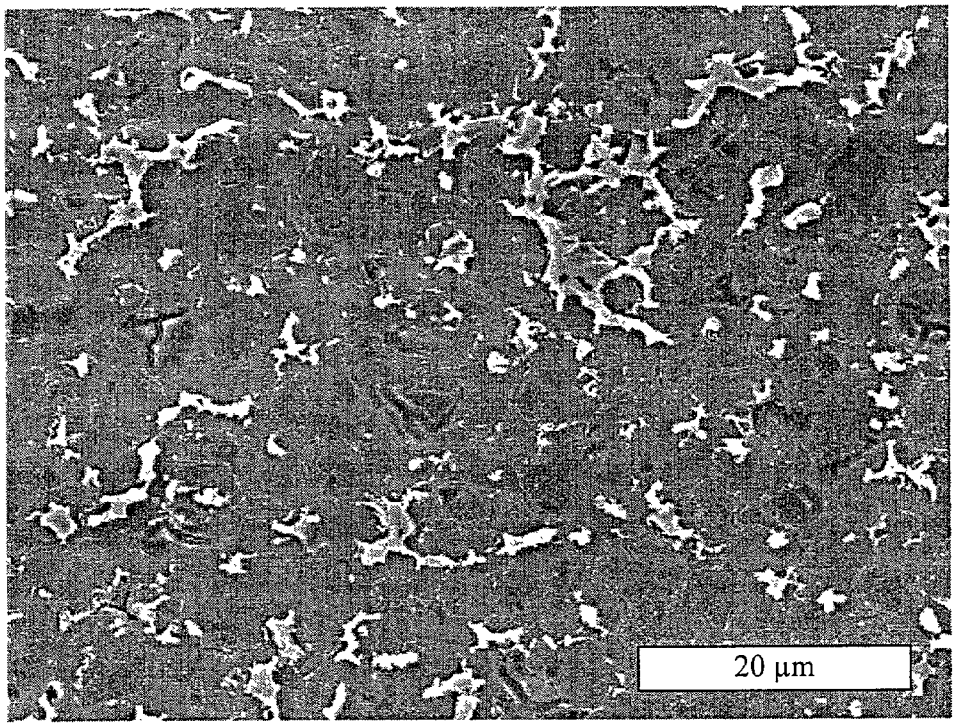
FIGS. 6, A and B, show the microstructures of a die cast alloy according to Comparative Example 1 and Comparative Example 2, respectively.
Figure 6B:
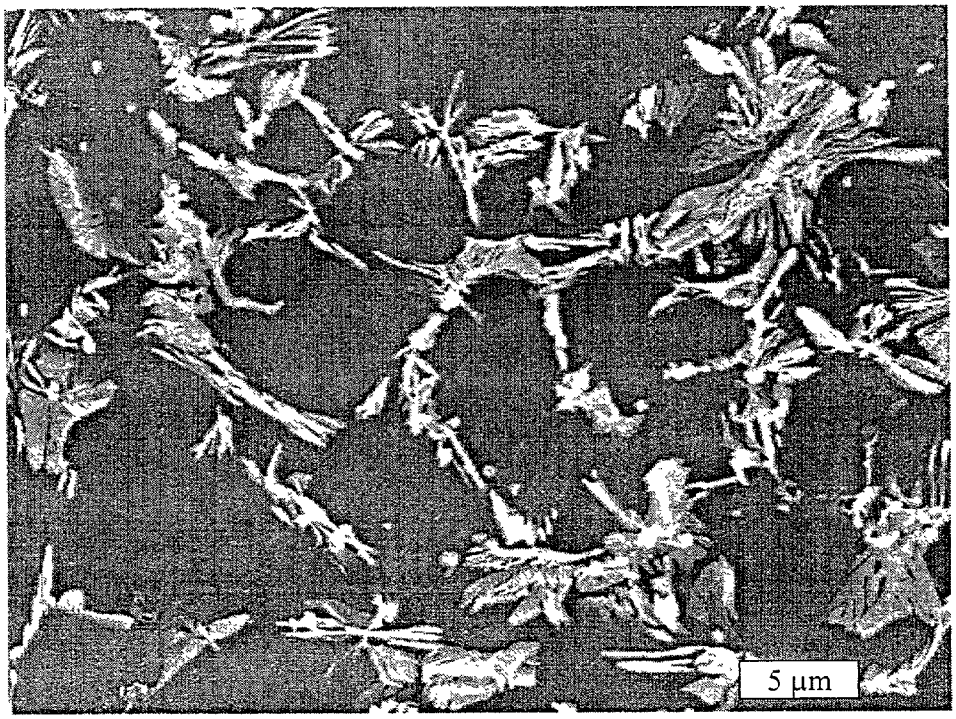

Tables 1 to 4 illustrate chemical compositions and properties of alloys according to the invention and alloys of comparative examples. Table 1 shows chemical compositions of 14 new alloys along with five comparative examples. The comparative examples 1 and 2 are the commercial magnesium alloys AZ91D and AE42, respectively. The results of the metallography examination of the new alloys and comparative examples 1 and 2 are shown in FIGS. 5–8. The microstructure of new alloys consisted of fine grains of Mg—Al solid solution and eutectic phases located at grain boundaries. These precipitates were identified using an X-Ray diffraction analysis and EDS analysis. The results obtained are listed in Table 2 along with data obtained for comparative examples.

As can be seen from Table 2, alloying with aluminum, calcium, strontium, rare earth elements, manganese and zinc leads to the formation of new precipitates that are different from the intermetallics, which are formed in AZ91D and AE42 alloys.

Die castability properties of new alloys are given in Table 3. The results distinctly show that new alloys of the present invention exhibit die castability similar to that of AZ91D, and considerably better than that of AE42 (Comparative Example 1) or other Comparative Examples. The tensile, compression and corrosion properties of new alloys are shown in Table 4. The alloys of the present invention exhibit higher Tensile Yield Strength (TYS) and higher Compressive Yield Strength (CYS) at ambient temperature and at 150° C. than AZ91D alloy and significantly higher CYS and TYS than AE42 alloy.

Corrosion resistance of new alloys is also similar or better than that of AZ91D alloys and significantly better than corrosion resistance of AE42 alloy.

As can be seen from Table 4 that alloys of the present invention are significantly superior to AZ91D alloy in creep resistance at both 135° C. and 150° C. The difference in minimum creep rate (MCR) reaches, in some cases, magnitude of two orders. At 135° C. under stress of 85 Mpa, the alloys of the present invention also surpass the creep resistance of AE42 alloy.

While this invention has been described in terms of some specific examples, many modifications and variations are possible. It is therefore understood that within the scope of the appended claims, the invention may be realized otherwise than as specifically described.

The invention claimed is:

1. A magnesium based alloy, for high pressure die casting with good castability, having a minimum creep rate (MCR) at 150° C. of from 1.1 to $3.2\times10^{-9}$/s under the stress of 50 MPa in combination with a tensile yield strength (TYS) of from 145 to 182 MPa at ambient temperature, and an ultimate tensile strength (UTS) of from 244 to 275 MPa at ambient temperature containing:

a) at least 86 wt % Mg, b) 6.1 to 9.2 wt % aluminum, c) 0.08 to 0.38 wt % manganese, d) 0.00 to 0.9 wt % zinc, e) 0.2 to 1.2 wt % calcium, f) 0.2 to 1.4 wt % strontium, g) 0.00 to 0.8 wt % rare earth elements, h) 0.00 to 0.02 wt % zirconium, and i) up to 0.004 wt % iron, up to 0.001 wt % nickel, up to 0.003 wt % copper, and/or up to 0.03 wt % silicon wherein the total amount of calcium and strontium >0.9 wt % and wherein the alloy is beryllium-free.

2. An alloy according to claim 1, further comprising incidental impurities.

3. An alloy according to claim 1, wherein the total amount of calcium and strontium is higher than 0.9 wt % and lower than 1.6 wt %.

4. An alloy according to claim 1, which contains 7.8 to 8.8 wt % aluminum, 0.00 to 0.3 wt % zinc, 0.65 to 1.05 wt % calcium 0.25 to 0.65 wt % strontium, 0.00 to 0.2 wt % rare earth elements, and 0.08 to 0.28 wt % manganese.

5. An alloy according to claim 4, comprising in their structure an Mg—Al solid solution as a matrix, and intermetallic compounds $Mg_{17}Al_9Ca_2Sr$, $Al_2Ca_{0.5}Sr_{0.5}$, and $Al_8(Mn,RE)_5$, said intermetallic compounds being located at grain boundaries of the Mg—Al solid solution.

6. An alloy according to claim 1, wherein rare earth elements comprise a mischmetal.

7. An article which is a casting of a magnesium alloy of claim 1.

* * * * *